United States Patent [19]

Ewald

[11] 4,139,128

[45] Feb. 13, 1979

[54] VARIABLE SPRAY VALVE ASSEMBLY

[75] Inventor: Ronald F. Ewald, Rolling Meadows, Ill.

[73] Assignee: Seaquist Valve Co., a Division of Pittway Corporation, Cary, Ill.

[21] Appl. No.: 694,722

[22] Filed: Jun. 10, 1976

[51] Int. Cl.[2] ..... B05B 1/32

[52] U.S. Cl. ..... 222/402.17; 222/402.22

[58] Field of Search ..... 222/402.21, 402.22, 222/402.1, 402.17, 402.24; 251/353, 354

[56] References Cited

U.S. PATENT DOCUMENTS

| | | | |
|---|---|---|---|
| 2,565,954 | 8/1951 | Dey | 222/402.24 X |
| 3,060,965 | 10/1962 | Taggart | 222/402.22 X |
| 3,506,241 | 4/1970 | Ewald | 222/402.21 X |
| 3,653,558 | 4/1972 | Shay | 222/402.17 |
| 3,658,294 | 4/1972 | Ewald | 251/354 |
| 3,674,186 | 7/1972 | Ewald | 222/402.21 |
| 3,735,955 | 5/1973 | Kerr et al. | 222/402.21 X |

FOREIGN PATENT DOCUMENTS

| | | | |
|---|---|---|---|
| 2215605 | 3/1972 | Fed. Rep. of Germany | 251/354 |

*Primary Examiner*—Robert J. Spar
*Assistant Examiner*—Frederick R. Handren
*Attorney, Agent, or Firm*—Stein & Frijouf

[57] ABSTRACT

A valve assembly of the type primarily designed for use with an aerosol valve or like fluid dispenser including a valve body having movably disposed therein a valve stem sealer positioned in substantially biased, supporting engagement relative to the base of a valve stem. The valve stem is movably disposed relative to a sealing gasket and has its base portion specifically configured relative to a platform of the valve stem sealer such that substantially vertical movement of the valve stem results in either a flush engagement between the valve stem and the valve stem sealer or alternately an angular orientation therebetween. A variable spray rate of dispensing the product within the dispenser results from the product being forced through either a metering port formed between the valve stem and the valve stem sealer (low rate) or alternately directly between mating surfaces of the valve stem and the valve stem sealer when the valve stem is depressed at an angular orientation relative to the valve stem sealer as in conventional toggle action (high rate).

9 Claims, 6 Drawing Figures

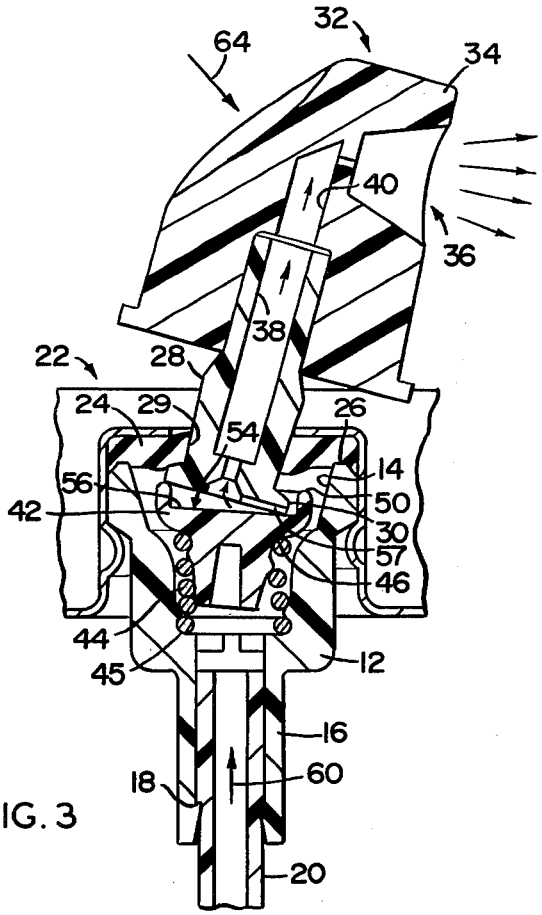
FIG. 3
FIG. 4
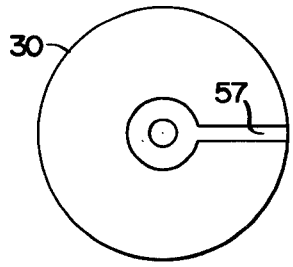
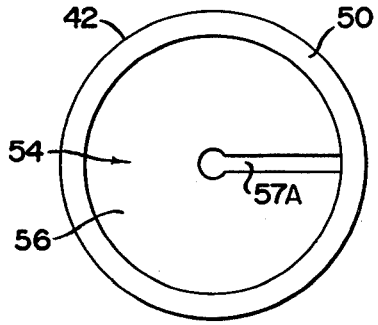
FIG. 5
FIG. 6
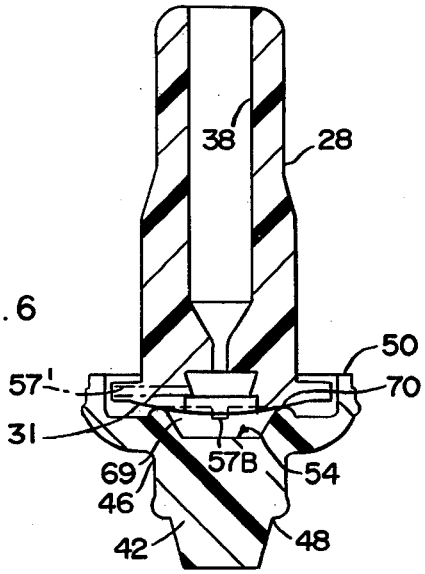

VARIABLE SPRAY VALVE ASSEMBLY

BACKGROUND OF THE INVENTION

1. Field of the Invention

This invention relates to a variable spray rate valve assembly of the type primarily designed for use with an aerosol or like fluid dispenser wherein specific manipulation of a valve actuating portion of the assembly may control the rate at which the product is dispensed from the dispenser through the specifically structured valve assembly.

2. Description of the Prior Art

With the increased popularity of fluid dispensers, especially of the aerosol type, and the accompanying introduction of a variety of new products, a number of increasing needs and demands are being called for by the general public. Among these is an efficient and reliable valve assembly which allows the dispensing of an aerosol product at variable rate of delivery. While a number of prior art structures have attempted to fulfill the industry's increasing demands, a number of these prior art structures have been found to be overly complexed, less than reliable and sometimes difficult to operate.

Such variable rate valve assemblies are highly desirable for use with products such as hair lacquer, cosmetics, paint or the like. The need for varying spray rates and/or spray patterns may change during the application of such product as can well be imagined. Such situations may be particularly evident in applying paint, enamel, varnish or the like to surfaces of varying types or configurations.

Existing prior art structures are represented in the structure shown in U.S. Pat. No. 3,206,082. Valve assemblies of this type usually comprise vertically aligned button actuator elements and valve stem combinations wherein at least one includes a plurality of apertures formed therein to register with at least one aperture formed in the counterpart element. A variable spray rate or pattern is produced by registering apertures of varying sizes. These structures generally require a twisting of the button actuator relative to the valve stem to achieve registry. Frequently such manual manipulation is not convenient and/or less than accurate depending upon the specific structural configuration of the elements comprising the subject valve assembly.

Similarly, U.S. Pat. Nos. 3,045,877 and 3,231,153 represent other devices which include depressing the button actuator and valve stem to varying depths. Accordingly, the effective size of a feed orifice is in direct proportion to the vertical displacement of the button actuator and/or valve stem. While structures of this type are generally considered functional they sometimes encounter the problems of accurate or positive indication of rate of delivery or control of the spray pattern characteristics which naturally would be desirable.

Another problem commonly associated with variable spray rate valve assemblies is accurate and reliable operation over a relatively wide range of pressures. As shown in U.S. Pat. No. 2,878,836 valve structures have been devised specifically directed to this varying pressure problem. However, a number of such structures are overly complex, less than accurate and frequently do not completely produce a satisfactory varying rate of delivery at lower pressures.

Accordingly, it is evident that a need still exists in the aerosol valve industry for a valve assembly capable of effectively and efficiently spraying product at varying rates with a minimal variance in manipulation of the valve actuator to accomplish such varying rate of delivery.

SUMMARY OF THE INVENTION

This invention relates to a valve assembly of the type primarily designed for use with an aerosol dispenser. More specifically, the valve assembly includes a valve body having a substantially hollow interior which defines the body cavity. A dip tube tail or like structure may be integrally or otherwise attached to the valve body. The dip tube tail is configured to engage the dip tube and position it in fluid communication with the body cavity.

The valve assembly further comprises a valve stem having a substantially hollow interior which defines a flow passage therein. The valve stem has a base portion movably disposed within the body cavity and at least partially supported therein by a valve stem sealer. The opposite end of the valve stem is connected to a valve actuator. This valve actuator per se does not form a part of the present invention and may be in the form of a valve button or a spray through overcap type structure which, when manipulated, may cause substantially vertical depression of the valve stem to activate the valve assembly as will be described in greater detail hereinafter. Alternately, the valve stem is sealingly engaged by a sealing gasket in such a manner that an angular orientation occurs between the valve stem and the valve stem sealer upon a substantially vertical, but toggle type action being supplied to the valve stem by virtue of the actuator.

The sealing gasket is disposed at the upper end of the valve body and sealingly engages the peripheral edge thereof. This disposition is accomplished by both the valve body and the sealing gasket being mounted in a substantially conventional type turret which serves to secure the entire valve assembly to the dispenser for dispensing of the product therefrom. The valve stem sealer is movably mounted in the body cavity by means of a biasing means in the form of a coil spring or the like. This biasing means normally biases the valve stem sealer into sealing engagement, about its periphery, with the sealing gasket. Furthermore, the disposition of the valve stem sealer is such as to be forced into mating engagement with the base portion of the valve stem.

The valve stem sealer includes a platform means formed thereon which has a supporting surface portion disposed and configured to engage the correspondingly positioned surface of the base portion of the valve stem. Therefore, since the valve stem sealer is forced upwardly by the biasing means into engagement with the sealing gasket, it is also forced upwardly such that the supporting surface portion engages the base portion of the valve stem and normally biases the entire assembly into its closed position which prevents escape or dispensing of product from the interior of the dispenser.

A metering port is disposed between the base portion and the platform means and serves as a first path of fluid flow between the body cavity and the interior of the valve stem or the interior flow passage therein. Upon vertical depression of the valve stem, along its vertical axis, the valve stem sealer will be forced to move against the biasing force of the biasing means and become disengaged from the sealing gasket. This will allow direct fluid communication between the interior flow passage in the valve stem and the body cavity or product within the aerosol dispenser.

However, due to the corresponding, predetermined configuration between the base portion of the valve stem and the platform means of the valve stem sealer, and angled vertical depression applied by force other than specifically along the vertical axis of the valve stem sealer will result in an angular or skewed relation of the base portion of the valve stem and the supporting surface portion of the valve stem sealer. This relationship may be generally termed a toggle action which eventually results in a camming type action being exerted between the undersurface of the base portion and the supporting surface portion of the valve stem sealer. When this type of action or force is placed on the valve stem, the valve stem sealer will again become disengaged from the sealing gasket. A second path of fluid flow is thereby defined from the body cavity to the interior flow passage in the valve stem by the fluid product flowing between the supporting surface portion and the undersurface of the base portion due to the angular orientation being established between the valve stem and the valve stem sealer.

Another embodiment of the present invention comprises the platform comprising an annularly configured seal ring integrally or otherwise formed thereon. The seal ring is disposed in engaging relation to the base of the valve stem. Further, the base of the valve stem includes a predetermined, substantially dome or semi-spherical configuration. This configuration of the base and its relation to the seal ring allows for an efficient seal therebetween, particularly during vertical activation. The sealing engagement acts similar to a ball and socket structuring insuring low range or rate of spray until the user "toggles" the stem to a high spray rate or rate of equivalency, as described in detail hereinafter.

In this embodiment the metering port may be disposed either through the seal ring or integrally formed in the spherical base.

An important feature of the present invention comprises the fact that a variable rate of product may be delivered from the valve assembly by virtue of the product flowing through the valve stem from either the first path of fluid flow or alternately the second path of fluid flow. The transverse dimension of the metering port means, in one embodiment of the present invention, is less than the transverse dimension of the interior flow passage. Accordingly, upon a straight in line, vertical depression of the valve stem along its vertical axis the product will be forced to flow from the body cavity, through the metering port and into the interior of the valve stem defined as the interior flow passage.

On the other hand if a vertical force is applied to the valve stem other than along its vertical axis, an angular or skewed disposition will result between the valve stem and the valve stem sealer. This forces the fluid product to flow along the second path of fluid flow between the supporting surface portion of the valve stem sealer and the undersurface of the base portion. Since this second path of fluid flow is dimensionally larger, product will flow into the interior flow passage of the valve stem at a greater rate than if such product passed through the metering port means which defines the first path of fluid flow. It is therefore readily seen that the spray rate of product dispersed may be increased merely by applying a "toggle action" to the valve stem rather than a straight in line vertical depressing force along the vertical axis of the valve stem.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 3 is a sectional view wherein product flow travels along a second fluid flow path.

FIG. 4 is a bottom view of one embodiment of the present invention wherein the metering port is integrally formed in the base of the valve stem.

FIG. 5 is a top view showing an alternative form wherein the metering port is integrally formed in the supporting surface of the valve stem sealer.

FIG. 6 is a sectional view showing an alternative form of the valve stem and the valve stem sealer.

Similar reference characters refer to similar parts throughout the several views of the drawings.

DETAILED DESCRIPTION

Figure 1:
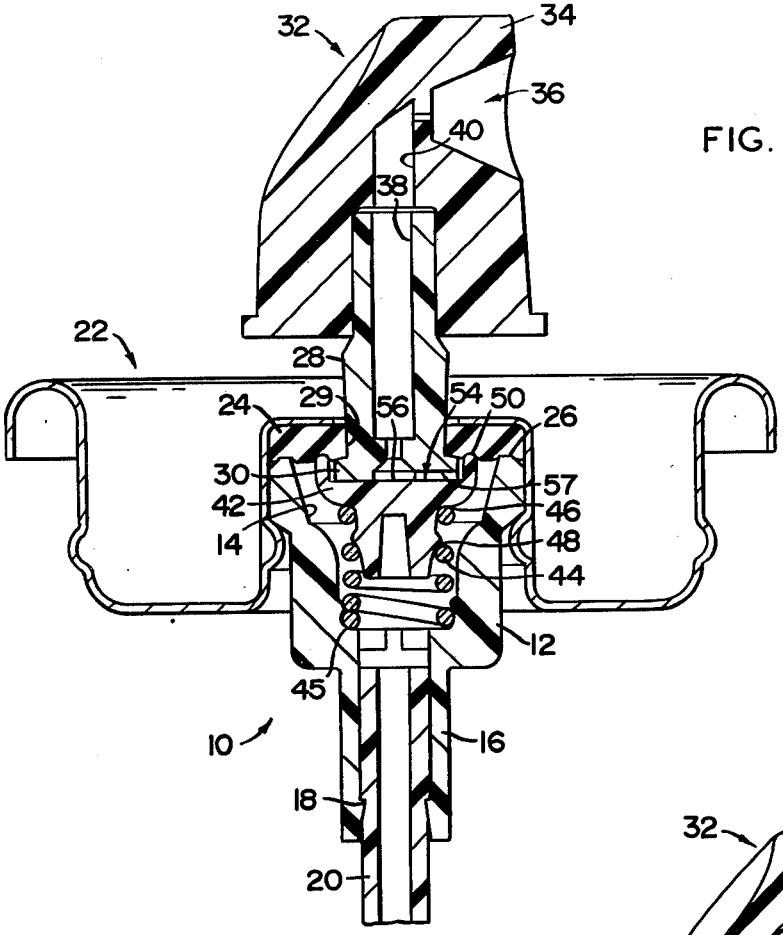
FIG. 1 is a sectional view showing the interior of the valve body and the relative disposition of the structural elements comprising the subject valve assembly.

As shown in FIG. 1 the valve assembly of the present invention is generally indicated as 10 and includes a valve body 12 having a body cavity 14 formed on the interior thereof. A tail portion 16 is integrally attached or otherwise connected to the valve body 12 and is configured to be attached, as at 18 to a dip tube 20. The dip tube 20 is disposed in fluid communication between the interior of the aerosol dispenser (not shown) and the body cavity 14.

The valve body 12, as well as other structural features of the subject valve assembly are connected to the dispenser by means of a substantially conventional turret generally indicated as 22. More specifically, a sealing gasket 24 is disposed in sealing engagement about the upper periphery 26 of the valve body 12. The sealing gasket 24 thereby seals off the body cavity 14 from the exterior of the dispenser on the other side of the turret shell 22.

Figure 2:
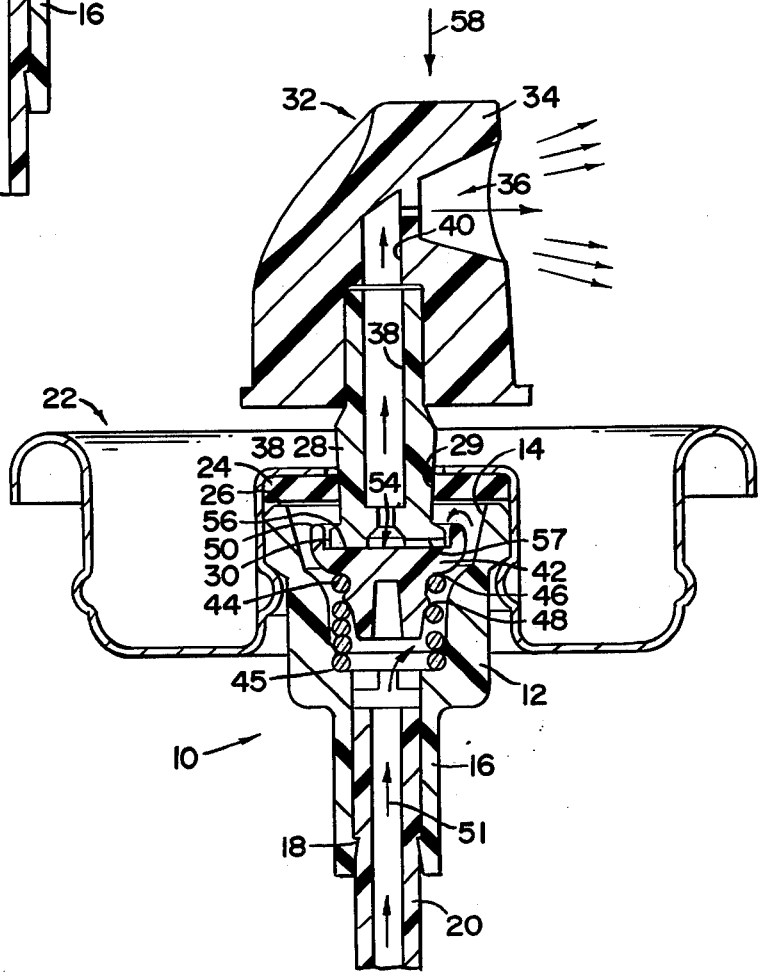
FIG. 2 is a sectional view wherein fluid flow of the product travels along a first flow path.

A valve stem 28 extends outwardly from turret 22 and has a base portion 30 movably mounted within the cavity 14 in sealed engagement with the gasket 24. As shown in FIGS. 1, 2 and 3 gasket 24 is disposed in surrounded, sealed engagement about the exterior surface of the valve stem 28 as at 29. The relative disposition of the stem 28 and the sealing gasket 24 allows relatively free movement of the base portion 30 of valve stem 28 as will be explained in greater detail hereinafter.

A valve stem actuator generally indicated as 32 is represented as a conventional valve button 34. Terminal orifice generally indicated as 36 is formed in one wall portion thereof and communicates with an inner flow passage 38 by means of chamber 40. It should be noted that the specific structural configuration of the valve actuator 32 is not per se a part of this invention. Accordingly, valve actuator 32 may take the form of a conventional button as represented by structure 34 or alternately may take the form of a spray through overcap or any other valve actuator structure capable of being connected to the valve stem 28 to accomplish vertical and/or angular depression thereof.

Other structural features of the subject invention include a valve stem sealer 42 movably mounted within body cavity 14 by attachment to a biasing means 44 in the form of a coil spring or like biasing element. The biasing means 44 is mounted on the floor of the body cavity 14 as at 45 and serves to engage the exterior surface of the valve stem sealer 42 as at 46 and 48. By virtue of this connection the valve stem sealer is biased normally into sealing engagement with the sealing gasket 24 about its upper peripheral surface indicated as 50.

The base portion 30 is thereby supportedly engaged on the platform means generally indicated as 54 which includes a supporting surface portion 56 which is disposed to engage and specifically configure to correspond to the undersurface of the base portion 30 of the valve stem 28.

With reference to FIGS. 2, 4 and 5, a first path of fluid flow is represented by directional arrows 51 wherein fluid product travels from the interior of the dispenser through the dip tube 20, into the body cavity 14 and enters the inner flow passage 38 by metering port means 57. This first path of fluid flow at least partially defined by the metering port means 57 is established upon a vertical downward force represented by directional arrow 58 in FIG. 2 being exerted on the valve actuator 32 substantially along the vertical axis of the valve stem 28. This will of course result in disengagement between the valve stem sealer 42 and the sealing gasket 24. Accordingly, pressure being exerted on the product within the dispenser causes the fluid to be forced to flow along the direction indicated by directional arrow 51.

With reference to FIG. 3 a second path of fluid flow is established from the interior of the dispenser (not shown) to the inner flow passage 38 of the valve stem 28 between the supporting surface portion 56 and the base portion 30 as indicated by directional arrows 60. Since the metering port means 57 is of smaller dimension than the second path of fluid flow as established between the supporting surface portion 56 and the base portion 30, the rate of fluid flow may obviously vary depending upon whether there is a flush, in line orientation between valve stem 28 and valve stem sealer 42 (FIG. 2) or an angular orientation between valve stem sealer 42 and the valve stem 28 (FIG. 3).

It should be obvious that the specific orientation between the valve stem 28 and the valve stem sealer 42 is dependent upon whether a vertical force as represented by directional arrow 58 (FIG. 2) is placed on the valve actuator 32 or a substantially angular force represented by directional arrow 64 (FIG. 3) is placed on the valve actuator 32. In the latter application a skewed or angular orientation exists as explained above and a substantially camming action occurs between the base portion 30 and the supporting surface portion 56 of the valve stem sealer.

In yet another embodiment of the present invention (FIG. 5) the metering port means 57A is integrally formed in the supporting surface portion 56 rather than in the undersurface of the base portion 30 of the valve stem 28 as shown in FIGS. 1 and 4.

Yet another embodiment of the present invention is disclosed in FIG. 6 comprises the valve stem 28 having a base portion 31 defining a dome-like or spherically shaped configuration as shown. Similarly, platform means 54 has formed thereon a sealing ring 69 which defines the engaging surface 70 disposed in direct sealing engagement with the spherical surface of base portion 31.

Further in this embodiment metering port 57B may be formed in seal ring 69. Alternately the metering port 57' may be integrally formed in the base 31 of valve stem 28. Operation for both vertical and toggle actuation is substantially the same as set forth with respect to the embodiment of FIGS. 1–4.

It will thus be seen that the objects set forth above, among those made apparent from the preceding description, are efficiently attained, and since certain changes may be made in carrying out the above method and article without departing from the scope of the invention, it is intended that all matter contained in the above description shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

Now that the invention has been described, what is claimed is:

1. A valve assembly of the type primarily designed for use with an aerosol dispenser, said valve assembly comprising: a valve body including a body cavity defined on the interior of said valve body, a valve stem having a flow passage on the interior thereof and including a base portion movably disposed within said body cavity, said base portion comprising a substantially spherical exterior surface, a sealing gasket connected to said valve body and sealingly engaging said valve stem, a valve stem sealer movably engaging said base portion and disposed in biased engagement with said sealing gasket and in fluid sealing disposition between said body cavity and said interior flow passage of said valve stem, said valve stem sealer comprising a platform including an annular surface projecting upwardly from said platform for sealing engagement with said substantially spherical surface of said base portion, metering port means disposed in fluid communicating relation between said interior flow passage and the exterior of said valve stem within said body cavity, said valve stem movably interconnected to said sealing gasket with said base portion being movably disposed on said valve stem sealer to provide an angular or flush relation between mating portions of said base portion and said valve stem sealer, whereby the rate of aerosol product flow from the dispenser is dependent upon relative orientation between said base portion and said valve stem sealer.

2. A valve assembly as in claim 1 wherein said metering port means is disposed to define a substantially exclusive path of fluid flow between said body cavity and said interior flow passage of said valve stem upon disengagement of said valve stem sealer from said sealing gasket in substantially flush orientation between said base portion and the mating portion of said valve stem sealer.

3. A valve assembly as in claim 1 wherein said platform annular surface is disposed in engaging, at least partially supporting relation to said base portion.

4. A valve assembly as in claim 3 wherein said annular surface is disposed relative to said base portion to define a fluid flow therebetween independent of said metering port means upon establishment of angular orientation of said base portion and said annular surface of said valve stem sealer.

5. A valve assembly as in claim 3 wherein disposition of said metering port means at least partially defines a first path of fluid flow between said body cavity and said interior flow passage of said valve stem sealer, upon substantially flush engagement between said base portion and said annular surface.

6. A valve assembly as in claim 5 wherein a second path of fluid flow from said body cavity to said interior flow passage is defined at least in part between said base portion of said valve stem and said annular surface of said valve stem sealer, upon angular orientation between said base portion and said annular surface.

7. A valve assembly as in claim 6 wherein said metering port means comprises a smaller transverse dimension than said interior flow passage, whereby rate of fluid flow from said body cavity to the exterior of the dispenser is greater along said second path of fluid flow than said first path of fluid flow.

8. A valve assembly as in claim 1 wherein said metering port means is formed in said base portion of said valve stem.

9. A valve assembly of the type primarily designed for use with an aerosol dispenser, said valve assembly comprising: a valve body including a body cavity defined on the interior of said valve body, a valve stem having a flow passage on the interior thereof and including a base portion movably disposed within said body cavity, a sealing gasket connected to said valve body and sealingly engaging said valve stem, a valve stem sealer movably engaging said base portion and disposed in biased engagement with said sealing gasket and in fluid sealing disposition between said body cavity and said interior flow passage of said valve stem, one of said base portion and said valve stem sealer comprising a substantially spherical exterior surface; the other of said base portion and said valve stem sealer comprising a platform including an annular surface projecting from said platform for sealing engagement with said substantially spherical surface; metering port means disposed in fluid communicating relation between said interior flow passage and the exterior of said valve stem within the body cavity, said valve stem movably interconnected to said sealing gasket with said base portion being movably disposed on said valve stem sealer to provide an angular or flush relation between mating portions of said base portion and said valve stem sealer, whereby the rate of aerosol product flow from the dispenser is dependent upon relative orientation between said base portion and said valve stem sealer.

* * * * *